US007025568B2

(12) United States Patent
Jones

(10) Patent No.: US 7,025,568 B2
(45) Date of Patent: Apr. 11, 2006

(54) TURBOMACHINE AEROFOIL

(75) Inventor: Richard M Jones, Skipton (GB)

(73) Assignee: Rolls-Royce plc, London (GB)

( * ) Notice: Subject to any disclaimer, the term of this patent is extended or adjusted under 35 U.S.C. 154(b) by 130 days.

(21) Appl. No.: 10/740,847

(22) Filed: Dec. 22, 2003

(65) Prior Publication Data

US 2004/0151585 A1 Aug. 5, 2004

(30) Foreign Application Priority Data

Jan. 30, 2003 (GB) ..... 0302160

(51) Int. Cl.
*F01D 5/16* (2006.01)
*F01D 5/26* (2006.01)

(52) U.S. Cl. ..... 416/90 R; 416/500; 29/889.72

(58) Field of Classification Search ..... 416/90 R, 416/132 A, 140, 500
See application file for complete search history.

(56) References Cited

U.S. PATENT DOCUMENTS

| | | | | |
|---|---|---|---|---|
| 3,806,275 A | | 4/1974 | Aspinwall | |
| 4,441,859 A | * | 4/1984 | Sadler | 416/96 A |
| 4,726,735 A | * | 2/1988 | Field et al. | 416/97 R |
| 5,457,884 A | * | 10/1995 | Fowler et al. | 29/889.72 |
| 6,158,963 A | * | 12/2000 | Hollis et al. | 416/219 R |

FOREIGN PATENT DOCUMENTS

| | | |
|---|---|---|
| GB | 1 345 835 SP | 2/1974 |
| GB | 2 106 996 A | 4/1983 |
| GB | 2 235 733 A | 3/1991 |
| GB | 2 371 095 A | 7/2002 |

* cited by examiner

*Primary Examiner*—Edward K. Look
*Assistant Examiner*—Richard A Edgar
(74) *Attorney, Agent, or Firm*—W. Warren Taltavull; Manelli Denison & Selter PLLC

(57) ABSTRACT

A fan blade (26) comprises a leading edge (44), a trailing edge (46), a concave wall portion (50) extending from the leading edge (44) to the trailing edge (46) and a convex wall portion (52) extending from the leading edge (44) to the trailing edge (46). A flexible wall (56) is arranged within the fan blade (26) to partially define a plurality of chambers (60) with an internal surface (54) of the convex wall portion (52). The flexible wall (56) is arranged substantially parallel to the internal surface (54) of the convex wall portion (52) and a plurality of walls (64) connect the internal surface (54) of the concave wall portion (50) and the flexible wall (56). The chambers (60) contain a fluid. The chambers (60) are interconnected by apertures (62) such that in operation deflection of the flexible wall (56) by vibrations of the fan blade (36) produce a flow of fluid between the chambers (60) through apertures (62), which is restricted by the apertures (62) to damp vibrations of the fan blade (26).

21 Claims, 4 Drawing Sheets

TURBOMACHINE AEROFOIL

FIELD OF THE INVENTION

The present invention relates to a turbomachine aerofoil and in particular the present invention relates to a gas turbine engine aerofoil, for example a fan blade, a compressor blade, a fan outlet guide vane or a compressor vane.

BACKGROUND OF THE INVENTION

Turbofan gas turbine engine fan blades suffer from high cycle fatigue, produced by high cycle vibrations, which significantly affects the performance and life of the fan blade.

Our published UK patent application GB2371095A discloses a turbomachine blade with a hollow interior and a viscoelastic vibration damping material is provided within the hollow interior of the turbomachine blade to damp vibrations of the turbomachine blade. However, it is difficult to inject the viscoelastic material into the hollow interior of the turbomachine blade, the viscoelastic material only damps vibrations over a limited temperature range, the viscoelastic material is not load bearing and the viscoelastic material may not withstand heat treatments required to manufacture a turbomachine rotor with integral hollow turbomachine blades.

SUMMARY OF THE INVENTION

Accordingly the present invention seeks to provide a novel turbomachine aerofoil, which reduces, preferably overcomes, the above-mentioned problems.

Accordingly the present invention provides a turbomachine aerofoil comprising a leading edge, a trailing edge, a concave wall portion extending from the leading edge to the trailing edge and a convex wall portion extending from the leading edge to the trailing edge, at least one flexible wall being arranged within the aerofoil to at least partially define a plurality of chambers, the chambers containing a fluid, the chambers being interconnected by apertures such that in operation deflection of the at least one flexible wall by vibrations of the aerofoil produces a flow of fluid between chambers through the apertures which is restricted by the apertures to damp vibrations of the aerofoil.

The flexible wall may be arranged to define a plurality of chambers with an internal surface of the concave wall portion, the flexible wall being arranged substantially parallel to the internal surface of the concave wall portion and at least one wall connecting the internal surface of the convex wall portion and the flexible wall.

Alternatively the flexible wall may be arranged to define a plurality of chambers with an internal surface of the convex wall portion, the flexible wall being arranged substantially parallel to the internal surface of the convex wall portion and at least one wall connecting the internal surface of the concave wall portion and the flexible wall.

Preferably a first flexible wall may be arranged to define a plurality of chambers with an internal surface of the convex wall portion and a second flexible wall being arranged to define a plurality of chambers with an internal surface of the concave wall portion, the first flexible wall being arranged substantially parallel to the internal surface of the convex wall portion and the second flexible wall being arranged substantially parallel to the internal surface of the concave wall portion and at least one wall connecting the first flexible wall and the second flexible wall.

Alternatively a first flexible wall being to arranged to define a plurality of chambers with a second flexible wall, the first and second flexible walls being substantially parallel, the first and second flexible walls connecting the internal surface of the concave wall portion and the internal surface of the convex wall portion.

Preferably the turbomachine aerofoil is compressor blade, a fan blade, a fan outlet guide vane or a compressor vane.

Preferably the concave wall portion, the convex wall portion, the at least one flexible wall comprise titanium or a titanium alloy.

Preferably the concave wall portion and the convex wall portion form a continuous integral wall. Preferably the concave wall portion, the convex wall portion and the at least one flexible wall are integral. Preferably the convex wall portion, the concave wall portion and the at least one flexible wall are diffusion bonded together and have been superplastically formed.

The fluid may be a gas, for example argon.

BRIEF DESCRIPTION OF THE DRAWINGS

The present invention will be more fully described by way of example with reference to the accompanying drawings in which.

DETAILED DESCRIPTION OF THE INVENTION

Figure 1:
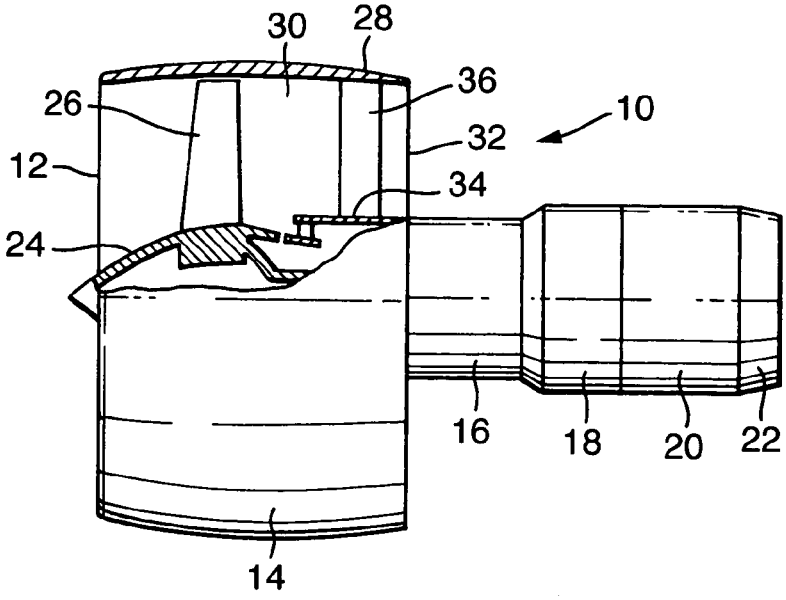
FIG. 1 shows a gas turbine engine having a turbomachine aerofoil according to the present invention.

A turbofan gas turbine engine 10, as shown in FIG. 1, comprises in axial flow series an inlet 12, a fan section 14, a compressor section 16, a combustion section 18, a turbine section 20 and an exhaust 22. The fan section 14 comprises a fan rotor 24 carrying a plurality of equi-angularly spaced radially outwardly extending fan blades 26. The fan blades 26 are surrounded by a fan casing 28, which defines a fan duct 30, and the fan duct 30 has an outlet 32. The fan casing 28 is supported from a core engine casing 34 by a plurality of radially extending fan outlet guide vanes 36.

The turbine section 20 comprises one or more turbine stages to drive the compressor section 18 via one or more shafts (not shown). The turbine section 20 also comprises one or more turbine stages to drive the fan rotor 24 of the fan section 14 via a shaft (not shown).

Figure 2:
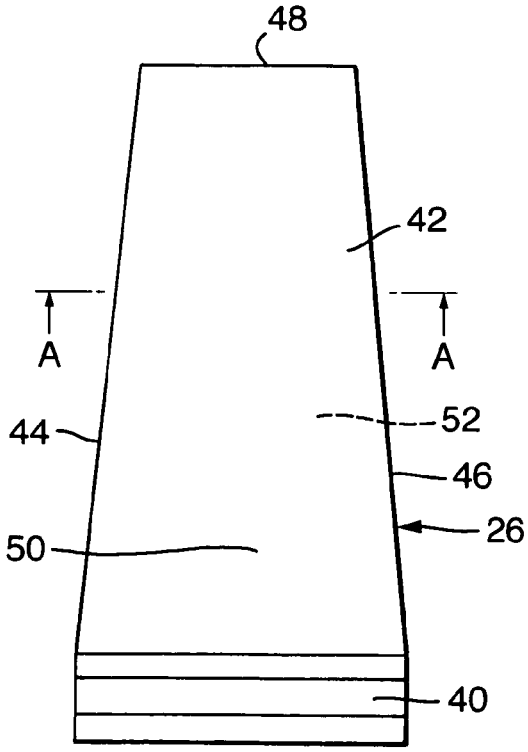
FIG. 2 is an enlarged view of a fan blade according to the present invention.
Figure 3A:
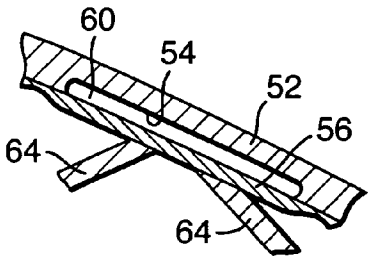
FIG. 3A is further enlarged portion of part of FIG. 3.
Figure 3:
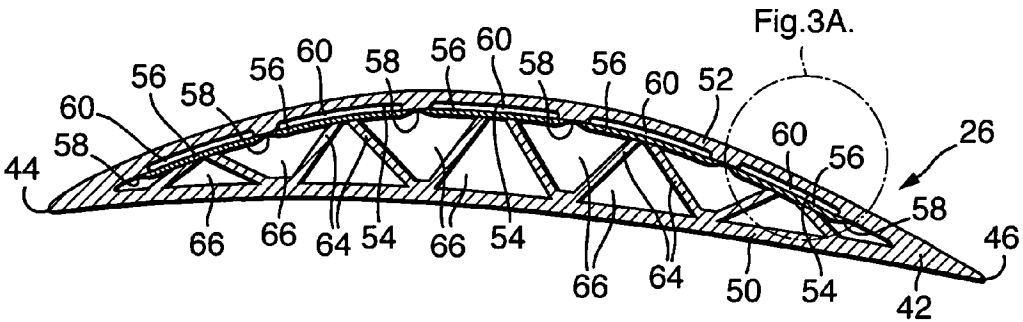
FIG. 3 is an enlarged cross-section along the line A—A in FIG. 2.
Figure 4:
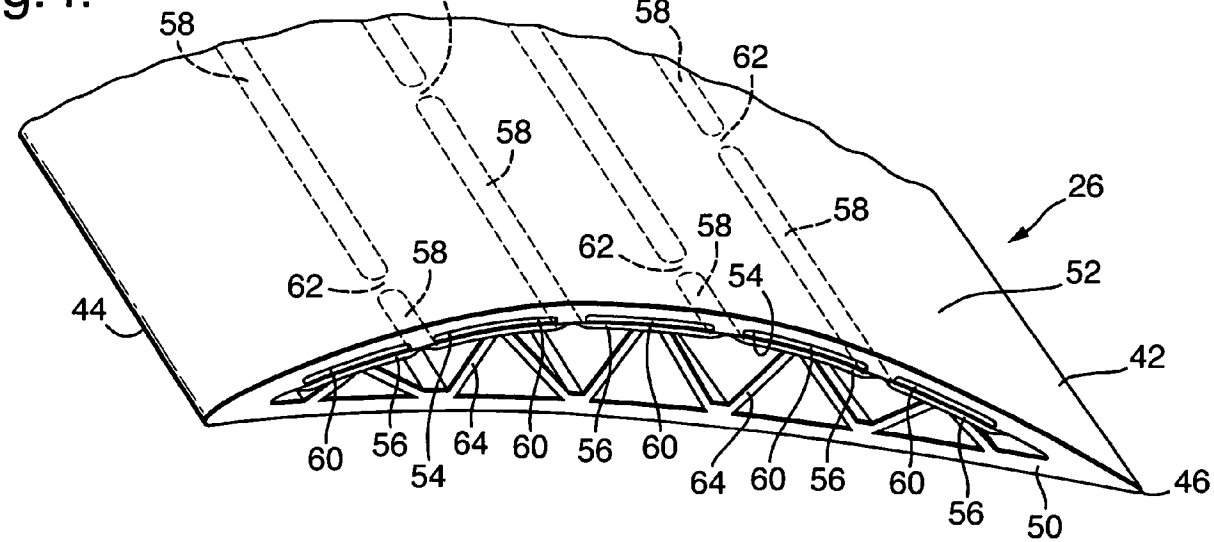
FIG. 4 is an enlarged perspective cut away view through the fan blade shown in FIG. 2.

One of the fan blades 26 is shown in more detail in FIGS. 2, 3 and 4. The fan blade 26 comprises a root portion 40 and an aerofoil portion 42. The root portion 40 comprises a dovetail root, a firtree root or other suitably shaped root for fitting in a correspondingly shaped slot in the fan rotor 24. The aerofoil portion 42 has a leading edge 44, a trailing edge 46 and a tip 48. The aerofoil portion 42 comprises a concave wall 50 which extends from the leading edge 44 to the trailing edge 46 and a convex wall 52 which extends from the leading edge 44 to the trailing edge 46. The concave and convex walls 50 and 52 respectively comprise a metal for example a titanium alloy.

The aerofoil portion 42 comprises a flexible wall 56 spaced from the internal surface 54 of the convex wall 52. The flexible wall 56 is arranged substantially parallel to the internal surface 54 of the convex wall 52. The flexible wall 56 is bonded to the internal surface 54 of the convex wall 52 by a plurality of joins 58 to define a plurality of sealed chambers 60. The joins 58 are spaced apart between the leading edge 44 and the trailing edge 46 and each join 58 extends in a direction from the root portion 40 to the tip 48. The joins 58 between adjacent chambers 60 are provided with one or more apertures 62 to interconnect the chambers 60. The chambers 60 are filled with a fluid, for example a gas.

The aerofoil portion 42 also comprises one or more walls 64 which extend between and are secured to the concave wall 50 and to the flexible wall 56 to form a warren girder structure to strengthen the aerofoil portion 42 and to define a plurality of chambers 66 between the concave wall 50, the flexible wall 56 and the walls 64. The chambers 66 are substantially evacuated. It is to be noted that the walls 64 are secured to the flexible wall 56 at positions substantially mid way between the joins 58 between the flexible wall 56 and the convex wall 52, as shown more clearly in FIG. 3A.

In operation of the turbofan gas turbine engine 10 any vibrations of the fan blade 26 are transferred by the walls 64 to the flexible wall 56 to produce deflection of the flexible wall 56. The deflection of the flexible wall 56 causes fluid to be displaced from one chamber 60 to one or more adjacent chambers 60 through the apertures 62 in the joins 58. The apertures 62 restrict the flow of fluid to the adjacent chambers 60 and hence absorb energy and damp vibrations of the fan blade 26.

Figure 5:
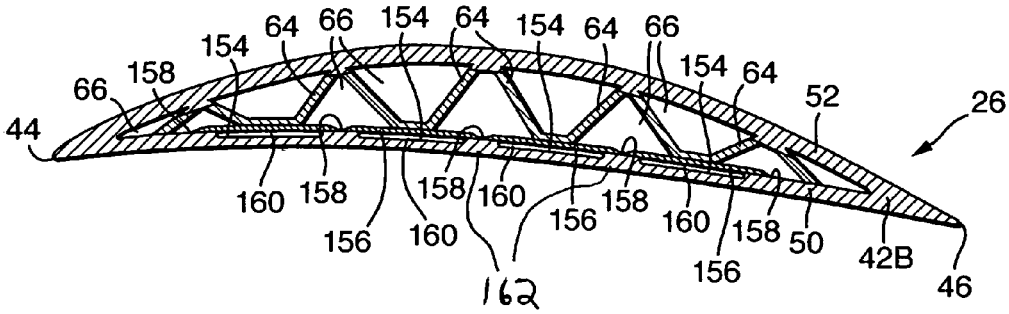
FIG. 5 is an alternative enlarged cross-section along the line A—A in FIG. 2.

A further fan blade 26 is shown in more detail in figures 2 and 5. The fan blade 26 comprises a root portion 40 and an aerofoil portion 42B. The root portion 40 comprises a dovetail root, a firtree root or other suitably shaped root for fitting in a correspondingly shaped slot in the fan rotor 24. The aerofoil portion 42B has a leading edge 44, a trailing edge 46 and a tip 48. The aerofoil portion 42B comprises a concave wall 50 which extends from the leading edge 44 to the trailing edge 46 and a convex wall 52 which extends from the leading edge 44 to the trailing edge 46. The concave and convex walls 50 and 52 respectively comprise a metal for example a titanium alloy.

The aerofoil portion 42B comprises a flexible wall 156 spaced from the internal surface 154 of the concave wall 50. The flexible wall 156 is arranged substantially parallel to the internal surface 154 of the concave wall 50. The flexible wall 156 is bonded to the internal surface 154 of the convex wall 50 by a plurality of joins 158 to define a plurality of sealed chambers 160. The joins 158 are spaced apart between the leading edge 44 and the trailing edge 46 and each join 158 extends in a direction from the root portion 40 to the tip 48. The joins 158 between adjacent chambers 160 are provided with one or more apertures 162 to interconnect the chambers 160. The chambers 160 are filled with a fluid, for example a gas.

The aerofoil portion 42B also comprises one or more walls 64 which extend between and are secured to the convex wall 52 and to the flexible wall 156 to form a warren girder structure to strengthen the aerofoil portion 42B and to define a plurality of chambers 66 between the convex wall 50, the flexible wall 156 and the walls 64. The chambers 66 are substantially evacuated. It is to be noted that the walls 64 are secured to the flexible wall 156 at positions substantially mid way between the joins 158 between the flexible wall 156 and the concave wall 50.

In operation of the turbofan gas turbine engine 10 any vibrations of the fan blade 26 are transferred by the walls 64 to the flexible walls 156 to produce deflection of the flexible wall 156. The deflection of the flexible wall 156 causes fluid to be displaced from one chamber 160 to one or more adjacent chambers 160 through the apertures 162 in the joins 158. The apertures 162 restrict the flow of fluid to the adjacent chambers 160 and hence absorb energy and damp vibrations of the fan blade 26.

Figure 6:
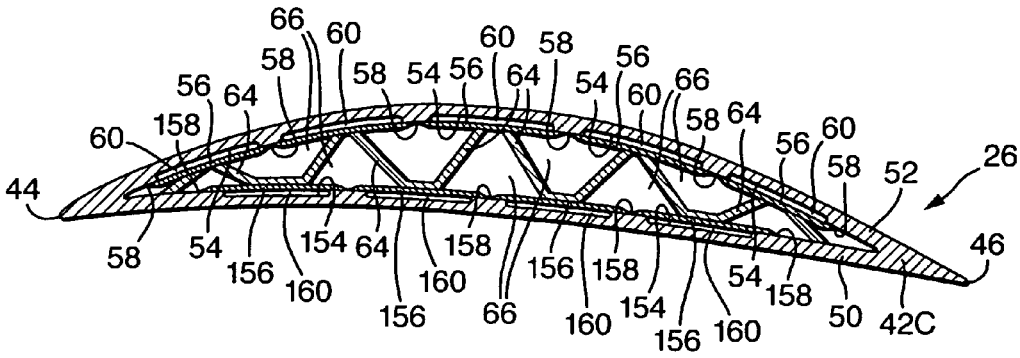
FIG. 6 is a further alternative enlarged cross-section along the line A—A in FIG. 2.

Another fan blade 26 is shown in more detail in figures 2 and 6. The fan blade 26 comprises a root portion 40 and an aerofoil portion 42C. The root portion 40 comprises a dovetail root, a firtree root or other suitably shaped root for fitting in a correspondingly shaped slot in the fan rotor 24. The aerofoil portion 42C has a leading edge 44, a trailing edge 46 and a tip 48. The aerofoil portion 42C comprises a concave wall 50 which extends from the leading edge 44 to the trailing edge 46 and a convex wall 52 which extends from the leading edge 44 to the trailing edge 46. The concave and convex walls 50 and 52 respectively comprise a metal for example a titanium alloy.

The aerofoil portion 42C comprises a first flexible wall 56 spaced from the internal surface 54 of the convex wall 52 and a second flexible wall 156 spaced from the internal surface 154 of the concave wall 50. The first flexible wall 56 is arranged substantially parallel to the internal surface 54 of the convex wall 52 and the second flexible wall 156 is arranged substantially parallel to the internal surface 154 of the concave wall 50. The first flexible wall 56 is bonded to the internal surface 54 of the convex wall 52 by a plurality of joins 58 to define a plurality of sealed chambers 60. The joins 58 are spaced apart between the leading edge 44 and the trailing edge 46 and each join 58 extends in a direction from the root portion 40 to the tip 48. The joins 58 between adjacent chambers 60 are provided with one or more apertures 62 to interconnect the chambers 60. The chambers 60 are filled with a fluid, for example a gas. The second flexible wall 156 is bonded to the internal surface 154 of the concave wall 50 by a plurality of joins 158 to define a plurality of sealed chambers 160. The joins 158 are spaced apart between the leading edge 44 and the trailing edge 46 and each join 158 extends in a direction from the root portion 40 to the tip 48. The joins 158 between adjacent chambers 160 are provided with one or more apertures 162 to interconnect the chambers 160. The chambers 160 are filled with a fluid, for example a gas.

The aerofoil portion 42C also comprises one or more walls 64 which extend between and are secured to the first flexible wall 56 and to the second flexible wall 156 to form a warren girder structure to strengthen the aerofoil portion 42C and to define a plurality of chambers 66 between the first flexible wall 56, the second flexible wall 156 and the walls 64. The chambers 66 are substantially evacuated. It is to be noted that the walls 64 are secured to the first flexible wall 56 at positions substantially mid way between the joins 58 between the first flexible wall 56 and the convex wall 52 and that the walls 64 are secured to the second flexible wall 156 at positions substantially mid way between the joins 158 between the second flexible wall 156 and the concave wall 50.

In operation of the turbofan gas turbine engine 10 any vibrations of the fan blade 26 are transferred by the walls 64 to the first flexible wall 56 to produce deflection of the first flexible wall 56. The deflection of the first flexible wall 56 causes fluid to be displaced from one chamber 60 to one or more adjacent chambers 60 through the apertures 62 in the joins 58. The apertures 62 restrict the flow of fluid to the adjacent chambers 60 and hence absorb energy and damp vibrations of the fan blade 26. Additionally any vibrations of the fan blade 26 are transferred by the walls 64 to the second flexible wall 156 to produce deflection of the second flexible wall 156. The deflection of the second flexible wall 156 causes fluid to be displaced from one chamber 160 to one or more adjacent chambers 160 through the apertures 162 in the joins 158. The apertures 162 restrict the flow of fluid to the adjacent chambers 160 and hence absorb energy and damp vibrations of the fan blade 26.

Figure 7:
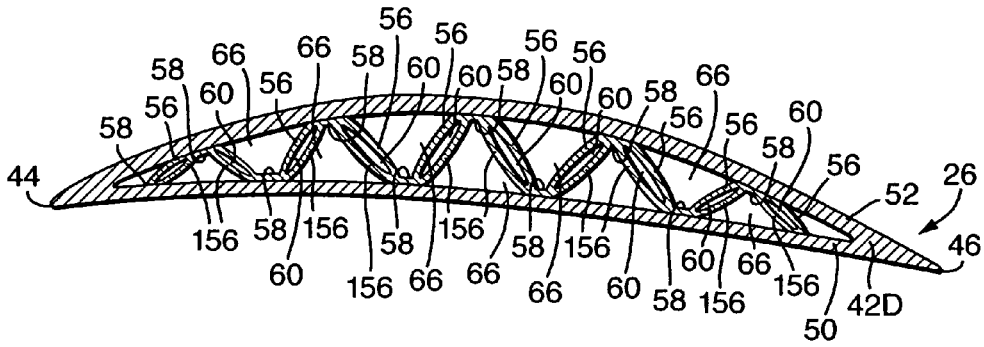
FIG. 7 is an additional alternative enlarged cross-section along the line A—A in FIG. 2.

Another fan blade 26 is shown in more detail in FIGS. 2 and 7. The fan blade 26 comprises a root portion 40 and an aerofoil portion 42D. The root portion 40 comprises a dovetail root, a firtree root or other suitably shaped root for fitting in a correspondingly shaped slot in the fan rotor 24. The aerofoil portion 42D has a leading edge 44, a trailing edge 46 and a tip 48. The aerofoil portion 42D comprises a concave wall 50 which extends from the leading edge 44 to the trailing edge 46 and a convex wall 52 which extends from the leading edge 44 to the trailing edge 46. The concave and convex walls 50 and 52 respectively comprise a metal for example a titanium alloy.

The aerofoil portion 42D comprises a first flexible wall 56 spaced from a second flexible wall 156. The first flexible wall 56 is arranged substantially parallel to the second flexible wall 156. The first flexible wall 56 is bonded to the second flexible wall 156 by a plurality of joins 58 to define a plurality of sealed chambers 60. The joins 58 between adjacent chambers 60 are provided with one or more apertures 62 to interconnect the chambers 60. The chambers 60 are filled with a fluid, for example a liquid or a gas. The gas may be argon, any other inert gas or gas which does not react with the walls of the fan blade 26.

The first and second flexible walls 56 and 156 extend between and are secured to the concave wall 50 and the convex wall 52 to form a warren girder structure to strengthen the aerofoil portion 42D and to define a plurality of chambers 66 between the first flexible wall 56 and the convex wall 52 and between the second flexible wall 156 and the concave wall 50. The chambers 66 are substantially evacuated.

In operation of the turbofan gas turbine engine 10 any vibrations of the fan blade 26 are transferred to the first and second flexible walls 56 and 156 to produce deflection of the first and second flexible walls 56 and 156. The deflection of the first and second flexible walls 56 and 156 causes fluid to be displaced from one chamber 60 to one or more adjacent chambers 60 through the apertures 62 in the joins 58. The apertures 62 restrict the flow of fluid to the adjacent chambers 60 and hence absorb energy and damp vibrations of the fan blade 26.

It is also possible to arrange for a passage to extend from the chambers 60 to an opening in the root 40 of the fan blade 26 and to provide a valve to control the flow of gas into/out of the chambers 60. The passage may be connected to a supply of gas so that the gas pressure in the chambers 60 may be adjusted, increased or decreased, in operation to control the amount of damping of the vibrations of the fan blade 26. The supply of gas may be for example a supply of air from the compressor section 16 of the turbofan gas turbine engine 10.

It is also possible to arrange for the gas pressure in the chambers 60 to be adjusted, increased or decreased, in operation to adjust the shape of the aerofoil portion 42 of the fan blade 26 to increase the performance of the aerofoil portion 42 of the fan blade 26. The change in gas pressure in the chambers 60 of the aerofoil portion 42 of the fan blade 26 changes the stagger angle and/or twist, particularly at the tip 48, of the fan blade 26.

Figure 8:
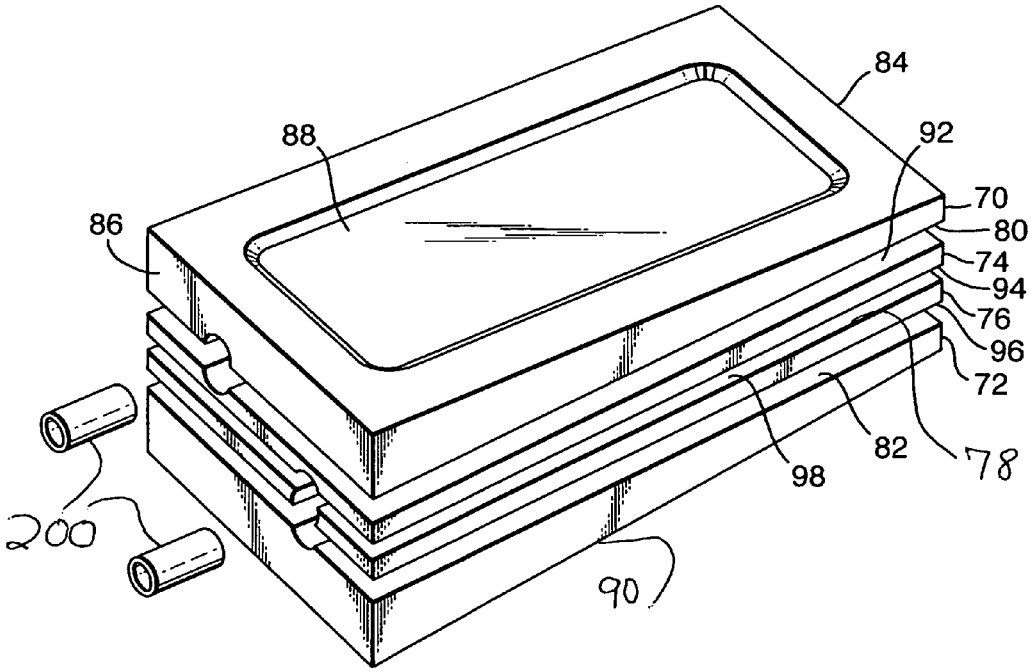
FIG. 8 is an exploded view of a stack of workpieces used to manufacture the fan blade shown in FIGS. 2 to 4.

The fan blade 26 in FIGS. 2, 3 and 4 is manufactured from four sheets 70, 72, 74 and 76 of titanium alloy which are assembled into a stack 78 as shown in FIG. 8. The sheets 70 and 72 have flat surfaces 80 and 82. The sheets 74 and 76 have flat surfaces 92, 94, 96 and 98. The sheets 70 and 72 taper, increase in thickness, longitudinally from the end 84 to the end 86. The thickest ends of the sheets 70 and 72 are arranged adjacent to each other to form the root 40 of the fan blade 26. The sheets 74 and 76 are placed in the stack between the sheets 70 and 72 such that the flat surface 80 of the sheet 70 abuts the flat surface 92 of the sheet 74 and the flat surface 82 of the sheet 72 abuts the-flat surface 96 of the sheet 76 and the flat surface 94 of the sheet 74 abuts the flat surface 98 of the sheet 76.

The titanium alloy sheets 70 and 72 may be produced by cutting an original parallelepiped block of titanium alloy along an inclined plane to form the two longitudinally tapering alloy sheets 70 and 72 as described more fully in our UK patent GB2306353B.

The central regions 88 and 90 of the sheets 70 and 72 are machined to produce a variation in the mass distribution of the fan blade 26 from leading edge 44 to trailing edge 46 and from root 40 to tip 48. The machining of the central regions 88 and 90 is by milling, electrochemical machining, chemical machining, electrodischarge machining or any other suitable machining process.

The surfaces 80, 82, 92, 94, 96 and 98 are prepared for diffusion bonding by chemical cleaning. One of the surfaces 80 and 92 has a stop off material applied in a predetermined pattern. One of the surfaces 82 and 96 has a stop off material applied in a predetermined pattern and one of the surfaces 94 and 98 has a stop off material applied in a predetermined pattern. The stop off may comprise yttria.

One or more pipes 200 are interconnected to the stop off material between the four sheets 70, 72, 74 and 76 and the sheets 70, 72, 74 and 76 are welded together around their peripheries to form the stack 78 and the pipes 200 are welded to the stack 78 to form a welded assembly. It is preferred to use one pipe at the end 86 to connect with the stop off material between the sheets 70 and 74 and to provide one pipe at the end 84 to connect with the stop off material between the sheets 72 and 76 and between the sheets 74 and 76.

The pipes 200 are interconnected to a vacuum pump, which is used to evacuate the interior of the welded assembly and then inert gas, for example argon, is used to purge the interior of the welded assembly. The welded assembly is placed in an oven and is heated to a temperature between 250° C. and 350° C. to evaporate the binder from the stop off material and the welded assembly is continuously evacuated to remove the binder.

After the binder has been removed the pipes 200 are sealed so that there is a vacuum in the welded assembly and the welded assembly is placed in an autoclave. The temperature in the autoclave is increased to a temperature greater than 850° C. and the pressure is increased to greater than $20\times10^5 Nm^{-2}$ and held at that pressure for a predetermined time to diffusion bond the sheets 70, 72, 74 and 76 together to form an integral structure. Preferably the temperature is between 900° C. and 950° C. and the pressure is between $20\times10^5 Nm^{-2}$ and $30\times10^5 Nm^{-2}$.

The interior of the integral structure is then placed in a hot creep-forming die and hot creep formed to produce an aerofoil shape. During the hot creep forming process the integral structure is heated to a temperature of 740° C.

The pipes are then replaced by other pipes. The hot creep formed integral structure is placed in a superplastic-forming die, which comprises a concave surface and convex surface. Inert gas, for example argon, is introduced, though the pipes, into the areas within the interior of the hot creep formed integral structure containing the stop off material to break the adhesive grip, which the diffusion bonding pressure has brought about. This is carried out at room temperature or at hot forming temperature.

The hot creep formed integral structure and superplastic-forming die is placed in an autoclave. The hot creep formed integral structure is heated to a temperature suitable for superplastic forming. The temperature for superplastic forming is greater than 850° C., preferably 900° C. to 950° C. Firstly, inert gas, for example argon, is introduced through the pipes 200 to the predetermined patterns between the sheets 72 and 76 and between the sheets 74 and 76 to hot form the sheets 70 and 72 onto the surface of the die to form the concave and convex walls 50 and 52 and to superplastically form the sheet 76 to form the walls 64 and the chambers 66 of the fan blade 26. Secondly, the chambers 66 are evacuated. Thirdly, an inert gas, for example argon, is introduced through the pipes 200 to the predetermined pattern between the sheets 70 and 74 to superplastically/hot form the sheet 74 to produce a small gap between the sheets 70 and 74 to form the chambers 60.

The fan blade 26 is then sealed such that there is substantially a vacuum in the chambers 66 and a fluid, for example a gas, e.g. argon or air, in the chambers 60.

The fan blade 26 in FIG. 5 is made in a similar manner, but the sheet 74 is superplastically formed to form the walls 64 and chambers 66 and the sheet 76 is superplastically/hot formed to produce the chambers 160.

The fan blade 26 in FIG. 6 is made with an additional sheet and in a similar manner by the combination of the steps in FIGS. 4 and 5.

The fan blade 26 in FIG. 7 is made by superplastically forming the sheets 74 and 76 to form the chambers 66 and then a small gap is produced between the sheets 74 and 76 to form the chambers 60.

Although the present invention has been described with reference to a fan blade, the invention is equally applicable to a compressor blade or a turbine blade. The present invention is also applicable to fan outlet guide vanes, compressor vanes or turbine vanes.

Although the invention has been described with reference to a fan blade having a root portion it may be possible for the fan blade not to have a root portion as such, but the inner end of the fan blade is friction welded, diffusion bonded or otherwise integrally secured to the fan rotor.

I claim:

1. A turbomachine aerofoil comprising a leading edge, a trailing edge, a concave wall portion extending from the leading edge to the trailing edge and a convex wall portion extending from the leading edge to the trailing edge, at least one flexible wall being arranged within the aerofoil to at least partially define a plurality of chambers, the chambers containing a fluid, the chambers being interconnected by apertures such that in operation deflection of the at least one flexible wall by vibrations of the aerofoil produces a flow of fluid between chambers through the apertures which is restricted by the apertures to damp vibrations of the aerofoil wherein the flexible wall is arranged to define a plurality of chambers with an internal surface of the concave wall portion, the flexible wall being arranged substantially parallel to the internal surface of the concave wall portion and at least one wall connecting the internal surface of the convex wall portion and the flexible wall.

2. A turbomachine aerofoil as claimed in claim 1 wherein the concave wall portion, the convex wall portion, the at least one flexible wall comprise titanium or a titanium alloy.

3. A turbomachine aerofoil as claimed in claim 1 wherein the concave wall portion and the convex wall portion form a continuous integral wall.

4. A turbomachine aerofoil as claimed in claim 1 wherein the concave wall portion, the convex wall portion and the at least one flexible wall are integral.

5. A turbomachine aerofoil as claimed in claim 4 wherein the convex wall portion, the concave wall portion and the at least one flexible wall are diffusion bonded together and have been superplastically formed.

6. A turbomachine aerofoil as claimed in claim 1 wherein the fluid comprises a gas.

7. A turbomachine aerofoil as claimed in claim 6 wherein the gas comprises argon or air.

8. A turbomachine aerofoil as claimed in claim 1 wherein there are means to control the pressure of the fluid in the chambers.

9. A turbomachine comprising a turbomachine aerofoil as claimed in claim 1.

10. A turbomachine as claimed in claim 9 wherein the turbomachine comprises means to supply fluid to the chambers of the turbomachine aerofoil to control the pressure of the fluid in the chambers.

11. A turbomachine as claimed in claim 10 wherein the turbomachine comprises a compressor to supply fluid to the chambers of the turbomachine aerofoil to control the pressure of the fluid in the chambers.

12. A turbomachine aerofoil comprising a leading edge, a trailing edge, a concave wall portion extending from the leading edge to the trailing edge and a convex wall portion extending from the leading edge to the trailing edge, at least one flexible wall being arranged within the aerofoil to at least partially define a plurality of chambers, the chambers containing a fluid, the chambers being interconnected by apertures such that in operation deflection of the at least one flexible wall by vibrations of the aerofoil produces a flow of fluid between chambers through the apertures which is restricted by the apertures to damp vibrations of the aerofoil wherein the turbomachine aerofoil is a compressor blade, a fan blade, a fan outlet guide vane or a compressor vane.

13. A turbomachine aerofoil as claimed in claim 12 wherein the flexible wall is arranged to define a plurality of chambers with an internal surface of the concave wall portion, the flexible wall being arranged substantially parallel to the internal surface of the concave wall portion and at least one wall connecting the internal surface of the convex wall portion and the flexible wall.

14. A turbomachine aerofoil as claimed in claim 12 wherein the flexible wall is arranged to define a plurality of chambers with an internal surface of the convex wall portion, the flexible wall being arranged substantially parallel to the internal surface of the convex wall portion and at least one wall connecting the internal surface of the concave wall portion and the flexible wall.

15. A turbomachine aerofoil as claimed in claim 12 wherein a first flexible wall is arranged to define a plurality chambers with an internal surface of the convex wall portion and a second flexible wall being arranged to define a plurality of chambers with an internal surface of the concave wall portion, the first flexible wall being arranged substantially parallel to the internal surface of the convex wall portion and the second flexible wall being arranged substantially parallel to the internal surface of the concave wall portion and at least one wall connecting the first flexible wall and the second flexible wall.

16. A turbomachine aerofoil as claimed in claim 12 wherein a first flexible wall is to arranged to define a plurality of chambers with a second flexible wall, the first and second flexible walls being substantially parallel, the first and second flexible walls connecting the internal surface of the concave wall portion and the internal surface of the convex wall portion.

17. A turbomachine aerofoil comprising a leading edge, a trailing edge, a concave wall portion extending from the leading edge to the trailing edge and a convex wall portion extending from the leading edge to the trailing edge, at least one flexible wall being arranged within the aerofoil to at least partially define a plurality of chambers, the chambers containing a fluid, the chambers being interconnected by apertures such that in operation deflection of the at least one flexible wall by vibrations of the aerofoil produces a flow of fluid between chambers through the apertures which is restricted by the apertures to damp vibrations of the aerofoil wherein the flexible wall is arranged to define a plurality of chambers with an internal surface of the convex wall portion, the flexible wall being arranged substantially parallel to the internal surface of the convex wall portion and at least one wall connecting the internal surface of the concave wall portion and the flexible wall.

18. A turbomachine aerofoil comprising a leading edge, a trailing edge, a concave wall portion extending from the leading edge to the trailing edge and a convex wall portion extending from the leading edge to the trailing edge, at least one flexible wall being arranged within the aerofoil to at least partially define a plurality of chambers, the chambers containing a fluid, the chambers being interconnected by apertures such that in operation deflection of the at least one flexible wall by vibrations of the aerofoil produces a flow of fluid between chambers through the apertures which is restricted by the apertures to damp vibrations of the aerofoil wherein a first flexible wall is arranged to define a plurality chambers with an internal surface of the convex wall portion and a second flexible wall being arranged to define a plurality of chambers with an internal surface of the concave wall portion, the first flexible wall being arranged substantially parallel to the internal surface of the convex wall portion and the second flexible wall being arranged substantially parallel to the internal surface of the concave wall portion and at least one wall connecting the first flexible wall and the second flexible wall.

19. A turbomachine aerofoil comprising a leading edge, a trailing edge, a concave wall portion extending from the leading edge to the trailing edge and a convex wall portion extending from the leading edge to the trailing edge, at least one flexible wall being arranged within the aerofoil to at least partially define a plurality of chambers, the chambers containing a fluid, the chambers being interconnected by apertures such that in operation deflection of the at least one flexible wall by vibrations of the aerofoil produces a flow of fluid between chambers through the apertures which is restricted by the apertures to damp vibrations of the aerofoil wherein a first flexible wall is to arranged to define a plurality of chambers with a second flexible wall, the first and second flexible walls being substantially parallel, the first and second flexible walls connecting the internal surface of the concave wall portion and the internal surface of the convex wall portion.

20. A method of manufacturing a turbomachine aerofoil from at least four metal workpieces comprising the steps of:

(a) forming at least four metal workpieces, (b) applying stop off material to predetermined areas of the surfaces of at least three of the at least four metal workpieces, (c) arranging the workpieces into a stack such that the stop off material is between the at least four metal workpieces, (d) heating and applying pressure across the thickness of the stack to diffusion bond the at least four metal workpieces together in areas other than the predetermined area to form an integral structure, (e) heating and internally pressurising the interior of the integral structure at the surfaces of at least two of the at least three metal workpieces to hot form at least two of the metal workpieces into an aerofoil shape to form a turbomachine aerofoil and to superplastically form at least one of the metal workpieces, (f) heating and internally pressurising the interior of the integral structure at the surface of the other one of the at least three metal workpieces to form at least one flexible wall to at least partially define a plurality of chambers, the chambers being interconnected by apertures, (g) supplying a fluid into the chambers.

21. A method as claimed in claim 20 comprising forming five metal workpieces.

* * * * *